US006747555B2

(12) United States Patent
Fellenstein et al.

(10) Patent No.: US 6,747,555 B2
(45) Date of Patent: Jun. 8, 2004

(54) TRACKING APPARATUS AND ASSOCIATED METHOD FOR A RADIO FREQUENCY ENABLED REMINDER SYSTEM

(75) Inventors: Craig William Fellenstein, Brookfield, CT (US); Rick Allen Hamilton, II, Charlottesville, VA (US); Gabe Van Duinen, West Ryde (AU); Campbell Victor Barford Watts, Killarney Heights (AU)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/254,833

(22) Filed: Sep. 24, 2002

(65) Prior Publication Data

US 2004/0066295 A1 Apr. 8, 2004

(51) Int. Cl.[7] ..... G08B 25/00

(52) U.S. Cl. ..... 340/524; 340/539.1; 340/539.1 B; 340/539.32; 340/572.1; 340/573.4

(58) Field of Search ..... 340/539.1, 539.11, 340/539.13, 539.14, 539.15, 539.16, 539.17, 539.18, 539.19, 539.21, 539.32, 568.1, 57.1, 572.1, 573.4, 524

(56) References Cited

U.S. PATENT DOCUMENTS

| | | | | |
|---|---|---|---|---|
| 5,583,488 A | 12/1996 | Sala et al. | ..... | 340/568 |
| 5,640,144 A | 6/1997 | Russo et al. | ..... | 340/568 |
| 5,714,932 A | 2/1998 | Castellon et al. | ..... | 340/539 |
| 5,714,937 A | 2/1998 | Campana, Jr. | ..... | 340/573 |
| 6,067,018 A | 5/2000 | Skelton et al. | ..... | 340/573.3 |
| 6,265,963 B1 | 7/2001 | Wood, Jr. | ..... | 340/10.4 |
| 6,397,301 B1 | 5/2002 | Quach et al. | ..... | 340/693.9 |
| 6,563,427 B2 * | 5/2003 | Bero et al. | ..... | 340/573.1 |
| 2001/0040513 A1 | 11/2001 | McDonald | ..... | 340/825.49 |
| 2002/0024443 A1 | 2/2002 | Hawkins et al. | ..... | 340/573.1 |

FOREIGN PATENT DOCUMENTS

| | | | | |
|---|---|---|---|---|
| WO | WO 84/03975 | 10/1984 | ..... | G08B/13/22 |
| WO | WO 95/32214 | 12/1995 | ..... | B01S/13/74 |
| WO | WO 01/50435 A1 | 7/2001 | ..... | G08G/1/017 |

* cited by examiner

*Primary Examiner*—Daryl Pope
(74) *Attorney, Agent, or Firm*—Samuel A. Kassatly

(57) ABSTRACT

An alert system and associated method protect against accidental loss or intentional theft of personal valuables. Users may define a set of corrective actions associated with each satellite item registered with the alert system. The alert system is generally comprised of a plurality of alert devices, a plurality of remote sensors, and at least one processing unit. When a satellite item provided with the alert device becomes separated from its user, the item alerts the user of an impending loss or separation prior to the occurrence of such an event.

22 Claims, 6 Drawing Sheets

TRACKING APPARATUS AND ASSOCIATED METHOD FOR A RADIO FREQUENCY ENABLED REMINDER SYSTEM

FIELD OF THE INVENTION

The present invention relates in general to a system and method for radio frequency tagging and tracking, and more particularly to an alert apparatus for use in an electronic reminder system, that protects an object within a defined electronic reminder system against loss or theft.

BACKGROUND OF THE INVENTION

In current technology, pervasive computing devices span personal digital assistants (PDAs) to embedded chips in telephones, smart appliances and automobiles. Pervasive computing is known as ubiquitous computing, wherein computing devices are interconnected via the Internet to encompass miniaturized computers inherently part of, and embedded within larger devices. Pervasive computing also refers to the plurality of interlinked, minuscule computing devices that are frequently invisible, often mobile or seamlessly integrated within the environment, that are easily accessible and connected to a progressively omnipresent network infrastructure.

An attribute of pervasive computing is the opportunity it presents in downsizing and integrating otherwise standalone technologies to create a vast, transparent computing environment catering to the comfort and safety of the end user. With the advancement of integrated circuit (IC) and communication technologies, increasing computing power can now be integrated into a single chip. The emergence of moderate bandwidth, near-field, digital, single-chip transceivers allows large numbers of portable intelligent devices to communicate with their peers and with a fixed-wire infrastructure.

Short-range, wireless radio frequency (RF) communications integrated circuit chips for both voice and data are well known. This technology makes peer-to-peer communications possible among dissimilar devices, facilitating the exchange of information between computing devices and communications devices.

It is quite common for personal devices, such as cellular telephones, car keys, and personal digital assistants, to be lost or misplaced. Therefore, when such a device is separated from its user, it is possible to locate this device, if it is still within a predetermined limited range, by triggering a response, such as an audible response, from the device. However, when the distance of the device from its owner exceeds the preset range, communication with the device is interrupted, which renders the tracking task quite difficult.

Therefore, there is still an unsatisfied need for device location and device location monitoring whereby pervasive computing allows electronics to be embedded into personal items to alert the owner of the location of a device when lost, to monitor the location of a device on an ongoing basis, or to be a predefined action when the location changes.

SUMMARY OF THE INVENTION

The alert system of the present invention satisfies these needs. The alert system is generally comprised of a plurality of alert devices, a plurality of remote sensors, and at least one processing unit. W When a satellite item is queried by the processing unit for its location, the satellite item will either reply with a location or not reply at all. If the satellite item replies and is in its predefined location no action is taken. If no reply is forthcoming from the satellite item or the satellite item is not in its predefined location then a predefined activity can take place.

In a preferred embodiment, the alert device communicates with a remote sensor, so that when the alert device becomes separated from the remote sensor beyond a predetermined period of time, and/or beyond a predetermined distance, the remote sensor notifies the processing unit, which, in turn, notifies the user of the impending loss or separation by means of an alert signal. The alert signal can be any of a visual signal, an audible signal, a data signal (i.e., text), and/or a video signal. As an example, the alert signal can be a small blinking light on a wristwatch, a cell phone call, a pager reminder, or another wearable device. Both the period of time and distance are configurable to meet the user's specific needs.

According to another embodiment of the present invention, the alert device is embedded in the item, while the alert device is carried by the user. In yet another alternate embodiment, the present alert system could be used by commercial enterprises for the maintenance of inventory and miscellaneous assets and in the prevention of potential loss or theft.

The alert system of the present invention can be implemented according to other alternative embodiments, among which are the following:

(1) Unrequested RF signals are periodically broadcast from the alert devices of the satellite items to a sensor or a plurality of sensors.

(2) The alert device of the satellite item is a call-and-response unit that acts as a transponder. Rather than seeking the periodic unrequested signals from the alert device (or devices), the processing unit prompts the alert devices to "check in" by sending a confirmation signal to the sensor.

(3) The processing unit determines the distance between the alert device and the user's sensor by measuring the strength of the signal from the alert device.

(4) The processing unit determines the distance between the alert device and the user's sensor by measuring the timing of the signals received from the alert device.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF PREFERRED EMBODIMENTS

The following definitions and explanations provide background information pertaining to the technical field of the present invention, and are intended to facilitate the understanding of the present invention without limiting its scope:

Electronic Reminder System (ERS) Remote Sensor: a receiver/transmitter wireless unit for detecting and managing satellite items.

ERS Satellite item: An attachable or an embedded receive/transmit unit that responds to radio frequency "pings" from the ERS remote sensor, or that sends out timed radio frequency (RF) signals according to a predetermined schedule. The satellite item can be secured to any personal property that can become readily lost or misplaced, which the user wishes to track.

Heartbeat: A periodic predefined ping from the ERS processing unit delivered to the ERS satellite item via the remote sensor to determine the location.

Satellite distance: A distance between a satellite item and the remote sensor.

Threshold distance: A distance over which an alert signal from the satellite item may be detected by an ERS processing unit.

Figure 1:
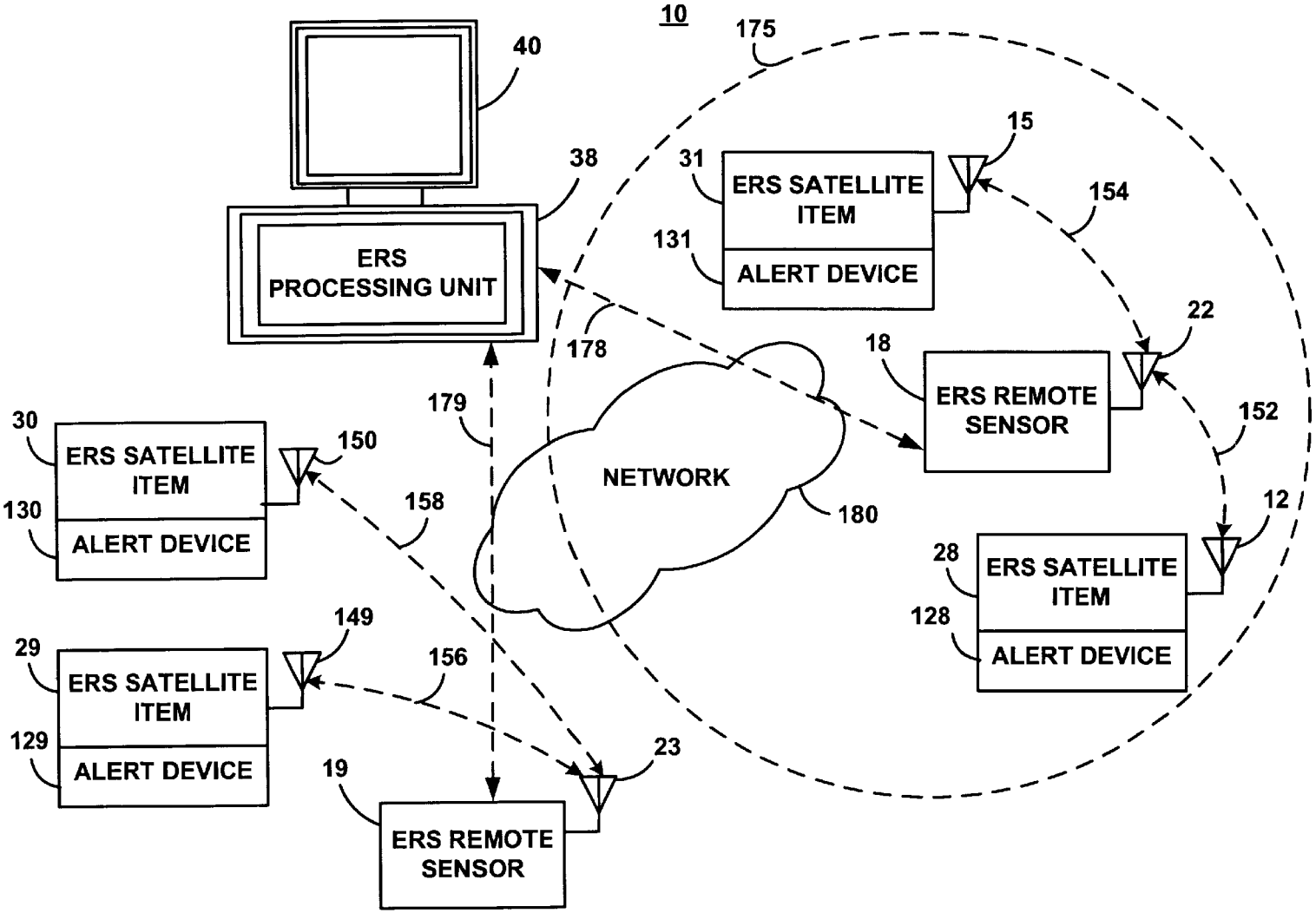
FIG. 1 is a high level block diagram of the alert system of the present invention.

FIG. 1 illustrates an alert system 10 of the present invention. System 10 comprises a plurality of remote sensors 18 and 19 in communication with an ERS processing unit 38 and a plurality of ERS remote devices 28, 29, 30, 31. Each of the remote sensors 18, 19 is provided with broadcast capability, such as by means of antennae 22, 23, respectively.

Each of the ERS satellite items 28, 29, 30, 31 is provided with an ERS alert device 128, 129, 130, 131, respectively. Preferably, each of the ERS alert devices 28, 29, 30, 31 is dedicated to the satellite item to which it is secured, so that the satellite items 28, 29, 30, 31 could be uniquely identified. Each of the alert devices 128,129,130,131 is provided with an antenna 141,148,149,150.

In operation, the remote sensor 18 is associated (or paired) with one or more satellite items, such as devices 28 and 31, and communicate with the alert devices 128, 131, over communications channels 152, 154, respectively. In a preferred embodiment, the communications channels 152, 154 are established by radio frequency signals. Similarly, the remote sensor 19 is associated (or paired) with one or more satellite items, such as devices 29 and 30, and communicate with the alert devices 129,130, over communications channels 156,158, respectively.

The ERS processing unit 38 includes a software program that configures or classifies the satellite items 28 and 29 and 30 and 31 as permanent or transient residents within an alert zone 175. In one embodiment, the alert zone 175 is centered around ERS remote sensor 18, and thus, when the satellite items 31 or 28 moves out of zone 175, a predetermined activity such as 370 or 380 can take place. The heartbeat function will periodically monitor for the satellite items' presence. Satellite distance can be used to locate a misplaced satellite item within a zone.

The user, such as the user carrying the remote sensor 18, assigns unique tag codes to all his or her satellite items, such as satellite items 28 and 31. The user logs the tag codes information into the ERS processing unit 38, which allows that processing unit 38 to calculate the relative positions of each individual satellite item 28, 31 relative to the remote sensor 18 and the alert zone 175.

The processing unit 38 sends requests to the remote sensors 18, 19 over communications channels 178, 179. In one embodiment, the processing unit 38 communicates with the remote sensors 18,19 over a network 180, as the World Wide Web, or the Internet.

The processing unit 38 interprets the responses from the remote sensors 18, 19. Alternately, the processing unit 38 and the remote sensors 18, 19 may be functionally integrated. A display unit 40 displays relevant information from the processing unit 38. This information can be persistent in nature, with updates entered periodically. The update periodicity could vary with the type of satellite item 18, 19 being tracked, and may correspond to predetermined heartbeat intervals that are configurable by the users.

Alternatively, the information displayed by the display unit 40 could be based on user-defined rules or parameters relating to the proximity of the satellite item 18, 19 relative to the remote sensor 18 and the alert zone 175. For example, predefined rules could be devised to create safe and non safe zones for children, whereby when a child moves from a designated safe zone to a designated non safe zone an alarm is sounded or a message send.

Figure 2:
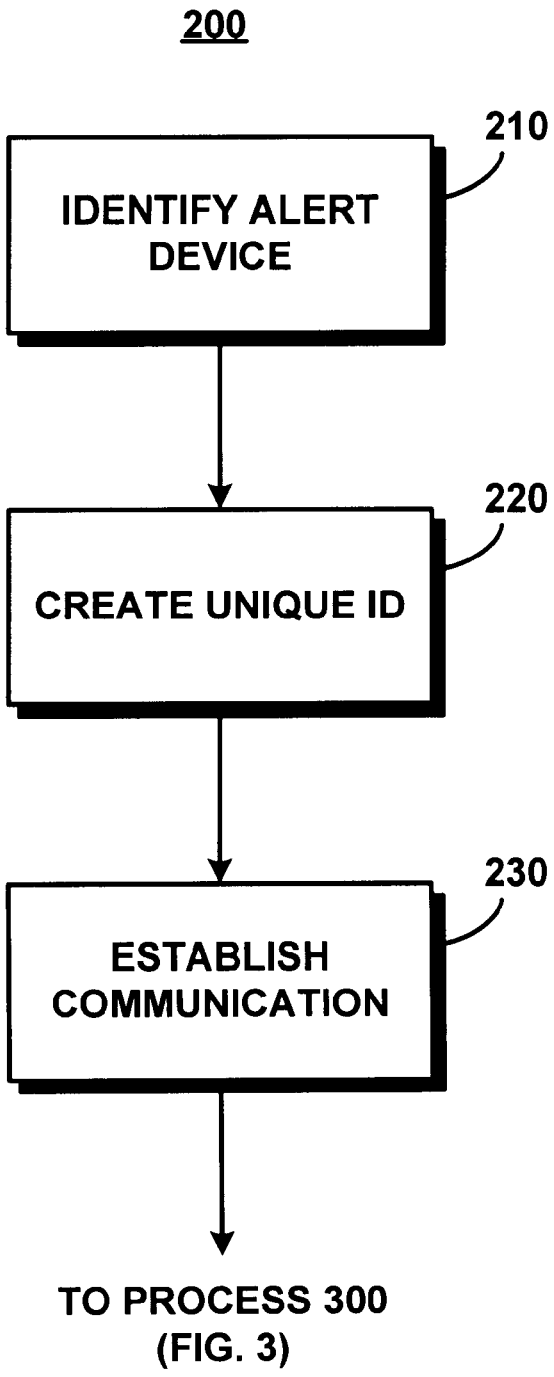
FIG. 2 illustrates a method of registering an alert device, or an ERS satellite item equipped with the alert device of the alert system of FIG. 1.

Referring now to FIG. 2, it illustrates a process 200 of registering an alert device, e.g., 128–131, or an ERS satellite item 28–31 of the alert system 10 of FIG. 1. Process 200 starts at block 210 by identifying the alert device 128–131 of interest, to be included in the alert system 10. Each satellite item 28–31 is equipped with one or more alert devices 128–131. As explained earlier, the satellite item 28–31 can be, for example, a cellular telephone, a personal digital assistants, or any other personal property of value.

At block 220, a unique identification record and code are created for each alert device 128–131 of the alert system 10. The records and codes of all the alert devices 128–131 of the alert system 10 can be stored in a local datastore, or remotely on one or more storage devices that are interconnect by the network 180.

At block 230, the processing unit 38 establishes communication with the alert devices 128–131 via corresponding remote sensors 18, 19, and registers these alert devices 128–131.

Figure 3:
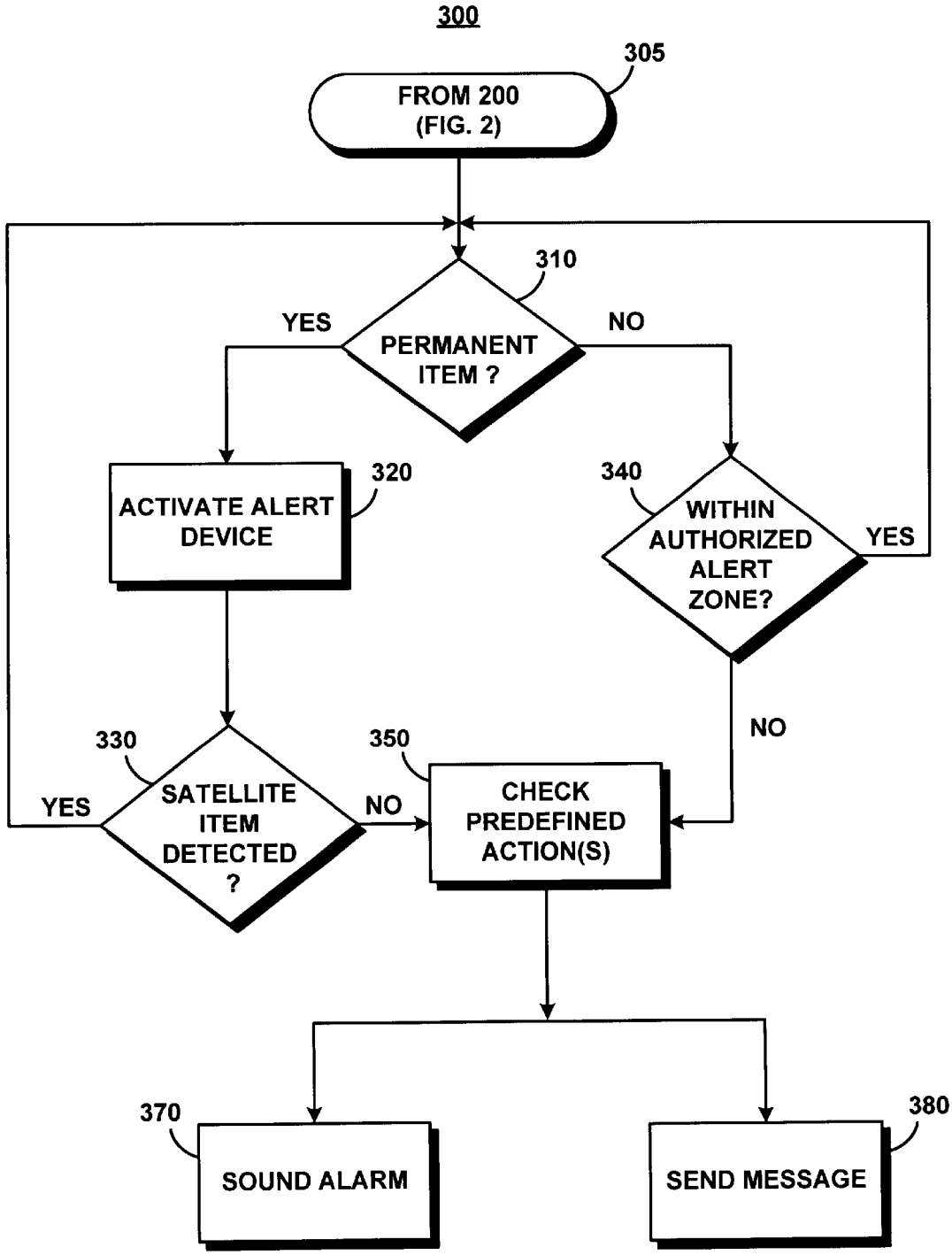
FIG. 3 is a flowchart of an activation and monitoring process performed by the alert system of FIG. 1, following the registration process of FIG. 2.

Once the registration process 200 is completed at step 230, and appropriate records created for the alert devices 128–131, system 10 proceeds to the activation and monitoring process 300 of FIG. 3. Method 300 starts at block 310 by having the processing unit 38 determine if the satellite item 28–31 to be included in system 10 is static or transient.

Static satellite items are items that do not move, or should not move outside the alert zone 175, for example a TV, a desktop PC, a painting, or similar personal property. Transient items are items that are not limited to a specific alert zone 175, for example, a vacuum cleaner, a key ring, or a pet.

If processing unit 38 determines that the satellite item 28–31 is a static or permanent item, it proceeds to block 320; otherwise, it proceeds to decision block 340. At block 320, system 10 activates the corresponding alert device 128–131, and monitors the static satellite item 28–31.

The monitoring function is accomplished by one of two ways. The first monitoring method is implemented by sending periodic signals from the ERS processing unit 38 to some or all of the alert devices 28–31, through the ERS remote sensor 18, 19. The processing unit 38 then analyzes response (or return) signals from the alert devices 28–31 to the processing unit 38. The return signals allow the processing unit 38 to confirm the presence of the satellite item 28–31 in a desired alert zone 175.

The second monitoring method is implemented by sending periodic signals from the ERS remote sensors 18, 19 to the various alert devices 28–31. The remote sensors 18, 19 then collect and store the response signals from the alert devices 28–31, and uploads this information to the processing unit 38 for processing and analysis. It should be clear that the remote sensors 18,19 could be capable of performing some or limited processing of the response signals.

In one embodiment, the processing unit 38 sends a single alert signal to the remote sensors 18,19. In turn, and for each alert device or a group of similar alert devices 28–31, the remote sensors 18, 19 encode the alert signal with a specific identification code. Similarly, the return signal is encoded with the identification code. In one embodiment, the identification code includes a group identification code that is common to the satellite items 28, 31 that belong to the same group or alert zone 175, and an item code that is specific to each satellite item 28 or 31.

Returning now to block 330 of FIG. 3, if the satellite item 28–31 is detected, the processing unit 38 returns to decision block 310 and continues the monitoring task. However, if the satellite item 28–31 is not detected, the processing unit 38 continues to block 350, as it will be described later in more detail.

At decision block 340, the processing unit 38 determines if the transient satellite item 28 is within or outside an authorized alert zone 175 based on the length of time it takes for the satellite item 28–31 to respond. For example, a dog provided with a transient satellite item 28 should not be located within the alert zone 175 if a child provided with a transient satellite item 31 is also in zone 175.

If the transient satellite item 31 is within the authorized alert zone 175, the processing unit 38 returns to step 310 as described earlier and continues the monitoring task. If, however, the transient satellite item 28 is within the unauthorized alert zone 175, the processing unit 38 proceeds to block 350.

At block 350, the processing unit 38 checks the predefined action(s) to be taken in response to the finding that the satellite item 28–31 has not been detected at decision step 330, or to the finding that the satellite item 28–31 is outside the authorized alert zone 175. One such action is to sound an alarm at step 370. The alarm may be, for example a subtle, blinking light on a wristwatch to notify the owner that the satellite item 28–31 has been left behind or is about to become missing. Another action is to send a message to a designation person or department at step 380. As an example, the processing unit 38 may connect to the Internet and send a notification message, a page, a short message server (sms), and so forth.

Figure 4A:
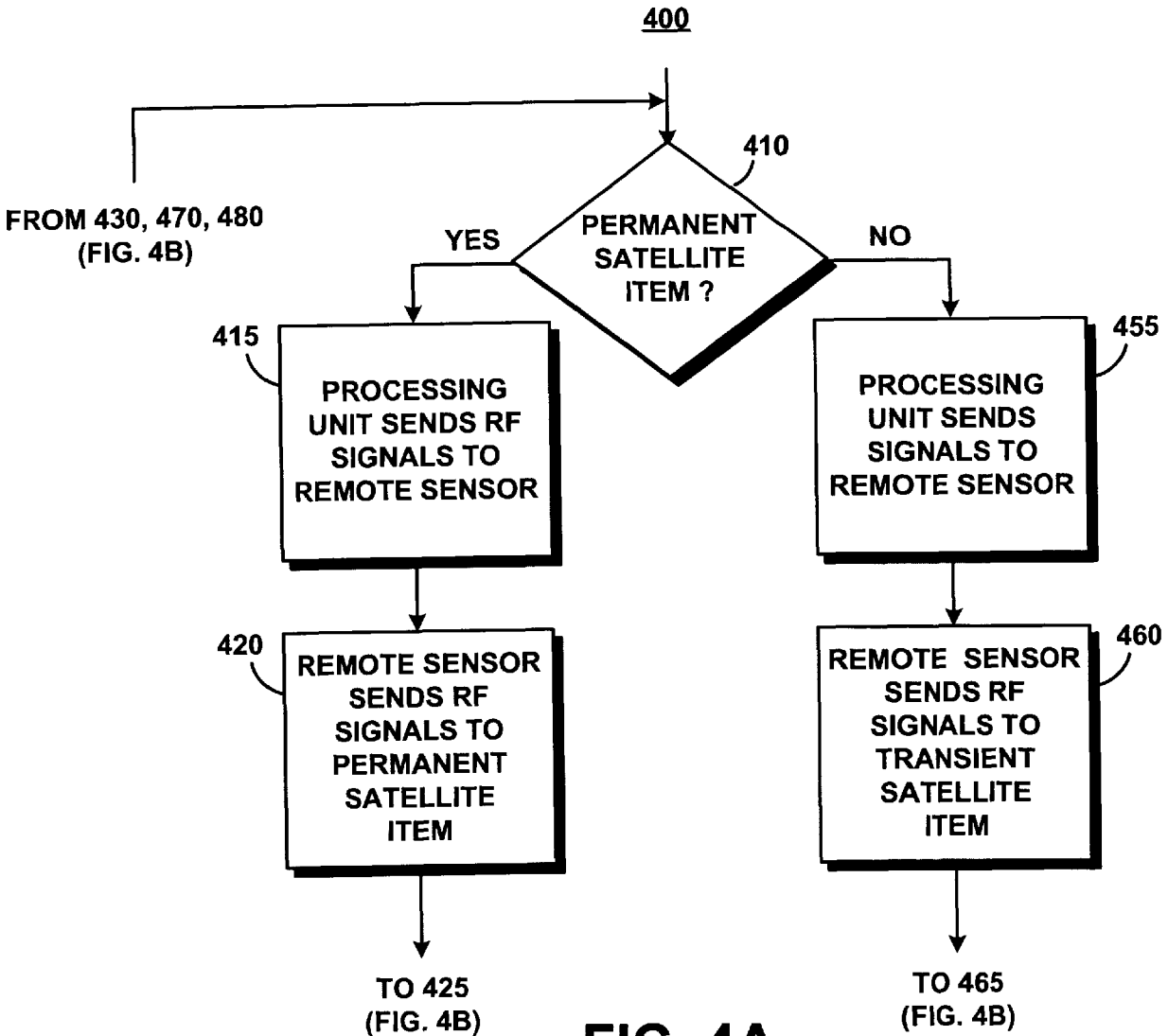
FIG. 4 is comprised of FIGS. 4A and 4B, and represents a flowchart that illustrates the tracking process of the alert system of FIG. 1.
Figure 4B:
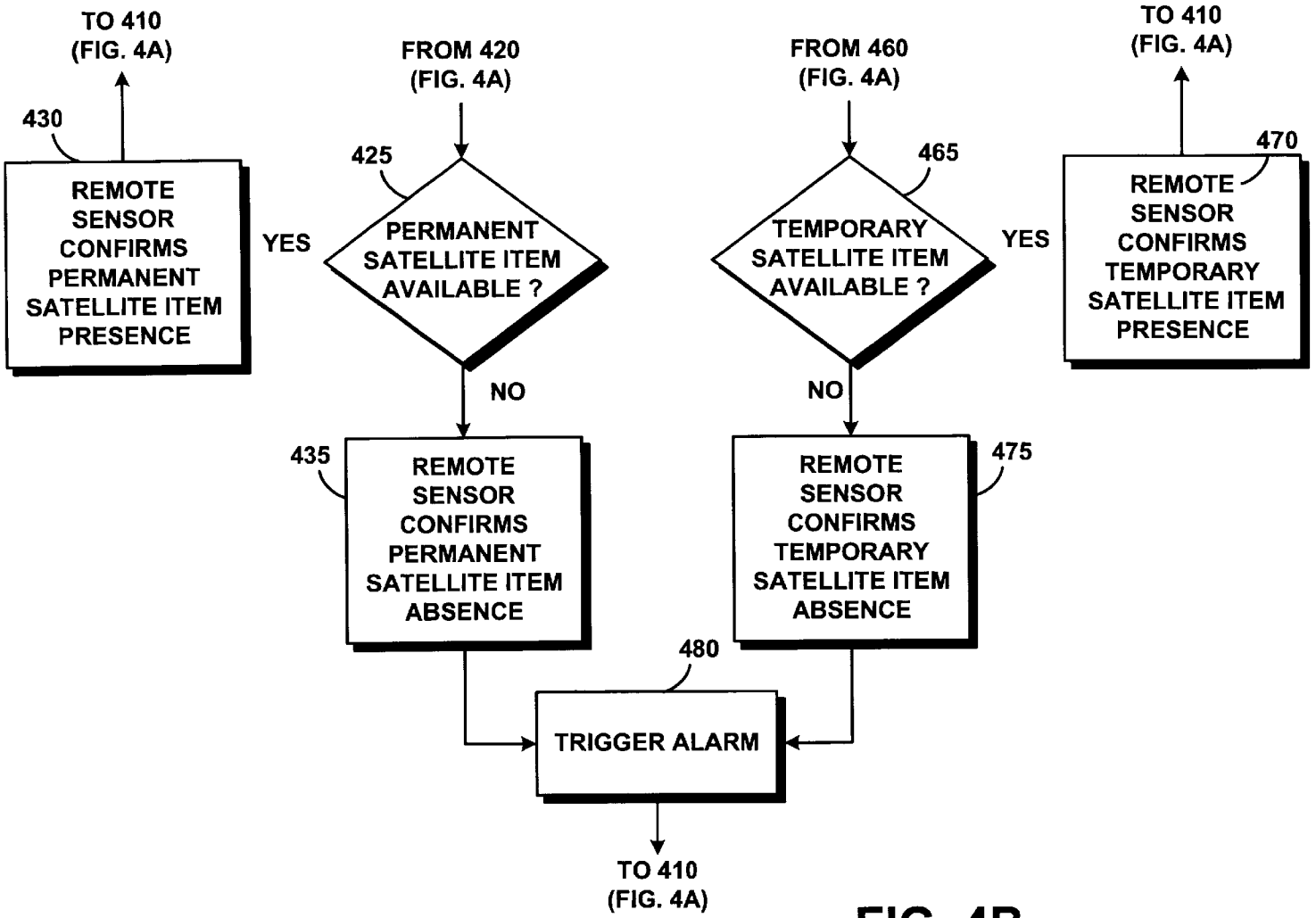

FIG. 4 is a flow chart of an exemplary tracking method 400 implemented by the alert system 10 according to one embodiment of the present invention. At decision block 410, method 400 inquires if the satellite item 28–31 is permanent or transient. If the satellite item 28–31 is permanent, method 400 continues to block 415; else, it proceeds to block 455.

At block 415, the processing unit 38 broadcasts radio frequency (RF) signals to the various remote sensors 18, 19, requesting the availability of the permanent satellite items, i.e., 28, 31, that are located in the alert zone 175, as registered with the processing unit 38 by means of uniquely identifying tag codes, according to process 200 of FIG. 2.

At block 420, a remote sensor, 18, 19, sends RF signals to the permanent satellite items, i.e., 28, 31, requesting confirmation of the availability and actual presence of the satellite items, i.e., 28, 31 in the alert zone 175. If any one of the satellite items 28, 31, is not available, such as when the alert device 128, 131, is deactivated or moved then a predefined activity can take place (block 480)

At decision block 425, method 400 determines if the permanent satellite items 28, 31 that have been queried at block 420, responded by sending back a RF signal within a predefined interval. If so, method 400 continues to block 430; else it proceeds to block 435.

At block 430, the remote sensor 18, 19 sends a signal to the processing unit 38 within a predefined interval, confirming the availability and presence of the permanent satellite items 28, 31. Method 400 then returns to decision block 410.

At block 435, having determined that a satellite item, i.e., 28, did not respond within a time interval that could be selected specifically for that satellite item 28, the remote sensor 18 sends a signal to the processing unit 38 informing it of the lack of response from the permanent satellite item 28 being tracked. Method 400 then proceeds to block 480.

At block 465, the processing unit 38 broadcasts RF signals to the remote sensors 18, 19 requesting confirmation of the availability and actual presence of the transient satellite items, i.e., 28, 31 in the alert zone 175. At block 460, the remote sensors 18, 19 send a RF signal to the transient satellite items 28–31, requesting confirmation of their availability or presence in the alert zone 175. If any one of the satellite items 28, 31, is not available, such as when the alert device 128,131, is deactivated or moved, then a predefined activity can take place.

At decision block 465, method 400 determines if a confirmation signal is received from the remote sensor 18,19. If a transient satellite item, i.e., 28 or 31, sends back a RF signal within a predefined time interval, to the remote sensor 18 that is primarily associated with this satellite item, or alternatively to another remote sensor, i.e., 19, that forms part of the alert system 10, and that is physically closer to the transient satellite item confirming the availability, presence, and/or location of the satellite item, method 400 continues to block 470; else it proceeds to block 475.

At block 470, the remote sensor 18,19 sends back a RF signal to the processing unit 38 within a predefined time interval, confirming the availability of the satellite item 28–31. Method 400 then returns to decision block 410.

At block 475, the remote sensors 18,19 send RF broadcast signals to the processing unit 38, advising the latter of the lack of response from one or more satellite items 28–31, within a predefined time interval. Method 400 then proceeds to block 480 and triggers an alarm in accordance with use defined rules that are stored in the processing unit 38. The type of alarm is based on the severity level of the situation, and may involve, for example, sending an Internet e-mail, or sounding an audible alarm. Method 400 then returns to decision block 410.

Figure 5:
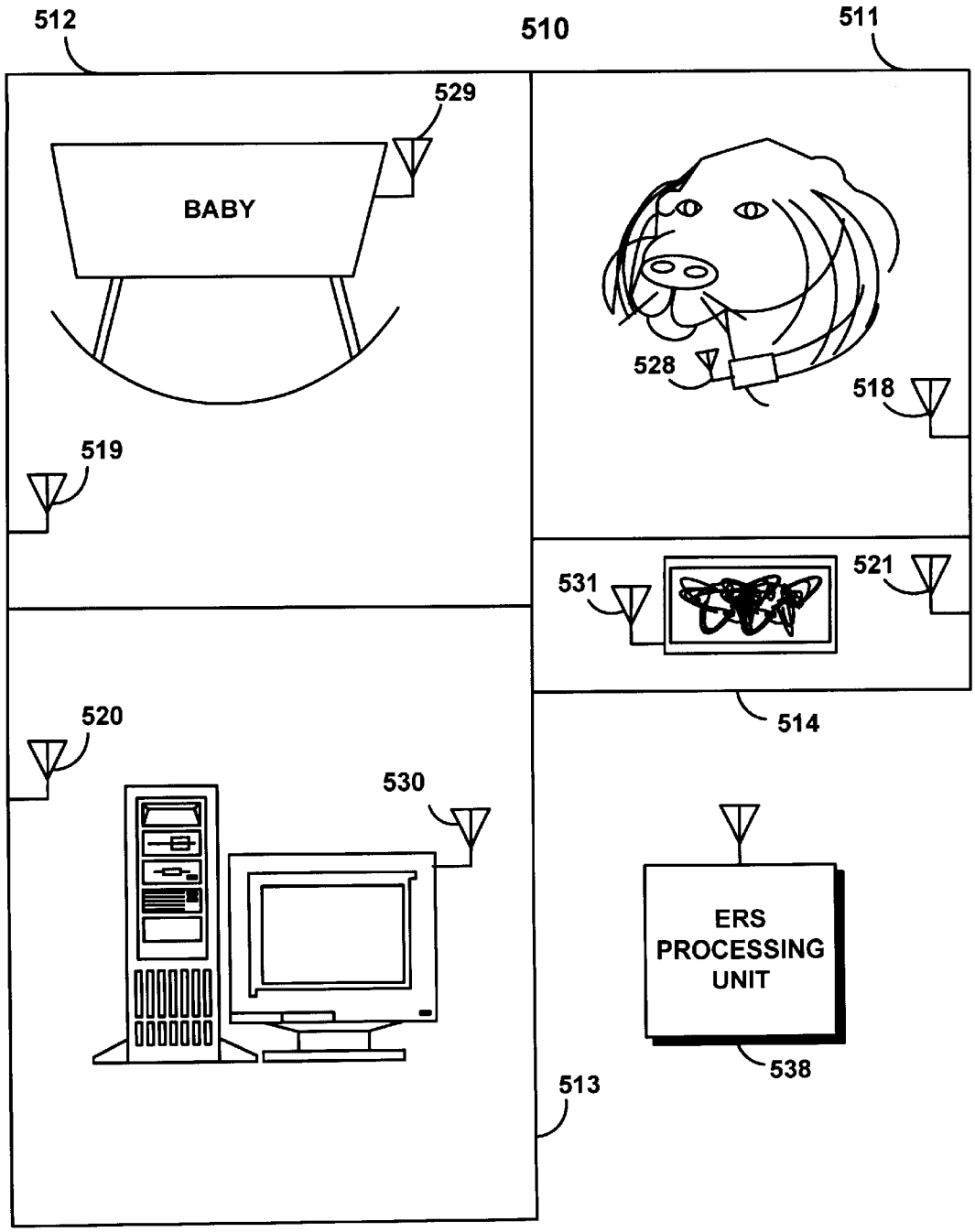
FIG. 5 is an example illustrating the use of the alert system of FIG. 1.

FIG. 5 is an example illustrating the use of the alert system 10. Similar to the alert system 10 of FIG. 1, the alert system 510 comprises a processing unit 538 in communication with a plurality of remote sensors 518, 519, 520, and 521. In this example, the system 510 is installed in a typical residence.

The exemplary residence is divided into a plurality of alert zones, as follows, wherein each alert zone can be defined, or programmed into the processing unit 538 by the user:

Alert zone 511 covers the kitchen and is monitored by remote sensor 518.

Alert zone 512 covers the nursery and is monitored by remote sensor 519.

Alert zone 513 covers the office and is monitored by remote sensor 520.

Alert zone 514 covers the hallway and is monitored by remote sensor 521.

Remote sensors 518, 519, 520, and 521 able to communicate bidirectionally with the processing unit 538, via commonly available wireless communication techniques. The remote sensors 518, 519, 520, and 521 communicate with any tagged satellite item in its designated alert zone.

Each satellite item may be transient or permanent, and is tagged with an identification tag that defines its status. Each identification tag transmits a unique tag code by RF waves to its corresponding remote sensor.

Satellite item 528 is worn by the dog, and is preferably a pervasive computing device. It is configured as a transient-type device, since the dog is allowed to roam throughout the residence. Satellite item 529 is attached to the baby's crib in the nursery. Satellite item 530 is attached to a personal computer in the office. Satellite item 531 is attached to a painting in the hallway. These satellite items 529, 530, 531 are configured as permanent-type devices as they are not supposed to be moved without prior authorization.

If, for example, a permanent-type satellite item, such as satellite item 531 has been moved from the hallway, i.e., alert zone 514, to another area, then an alarm would be triggered in accordance with user-specific rules stored in the processing unit 538.

The rules associated with the identity of a transient device define the alert zones in which the satellite zones are authorized to be located without triggering an alarm. An example of the rules associated with transient devices may be that the dog tagged with satellite item 528 is not permitted in the nursery, alert zone 512, that is monitored by remote sensor 519. Alternately, the dog is not permitted within a predefined distance from the nursery 512.

The processing unit 538 monitors the location of each satellite item, and determines the relative position of this satellite item, based on (a) the length of time it takes for the satellite item to respond to the processing unit 538, and (b) the remote sensor who reported the availability of the satellite item.

Each device identified to the processing unit 538 has a set of actions associated with the user-defined rules. The user may program the processing unit 538 to connect to the Internet and to send an e-mail message to the user when a satellite item is moved without authorization. As an example, a movement of a satellite item when the user has left the premises may indicate a theft is occurring.

It is to be understood that the specific embodiments of the present invention that are described herein are merely illustrative of certain applications of the principles of the present invention. Numerous modifications may be made without departing from the scope of the invention.

What is claimed is:

1. An alert system for tracking a satellite item, comprising:

a remote sensor that defines an alert zone;

a plurality of alert devices located within the alert zone, that are paired with a plurality of satellite items, and that communicate with the remote sensor to provide information about relative positions of the plurality of satellite items with respect to the alert zone and the remote sensor; and a processing unit that registers the plurality of alert devices and that communicates with the remote sensor, so that the remote sensor alerts the processing unit when a satellite item becomes disassociated from the remote sensor;

wherein the processing unit identifies the plurality of alert devices as transient items that are not limited to the alert zone, or permament items that are limited to the alert zone;

wherein the processing unit calculates a satellite distance between the remote sensor and each of the satellite items to determine the location of the satellite items relative to the remote sensor;

wherein the processing unit determines if a transient item is inappropriately located within the alert zone;

the remote sensor selectively providing an alert signal if any one of the satellite items becomes disassociated from the remote sensor; and the remote sensor further selectively providing the alert signal if the transient item is determined to be inappropriately located within the alert zone.

2. The alert system of claim 1, wherein the processing unit further determines if the transient item is inappropriately located within the alert zone concurrently with a permanent item; and if the transient item is inappropriately located within the alert zone, the processing unit calculates a response time to correct an adverse situation that could arise from the transient item that is inappropriately located within the alert zone.

3. The alert system of claim 2, further comprising a plurality of remote sensors that define a plurality of alert zones and that communicate with the plurality of alert devices.

4. The alert system of claim 3, wherein the processing unit communicates with the plurality of the remote sensors over a network.

5. The alert system of claim 4, wherein the network comprises the Internet.

6. The alert system of claim 1, wherein each alert device periodically transmits radio-frequency signals to the remote sensor to provide the relative position information of the satellite item that is paired with each alert device.

7. The alert system of claim 1, wherein the remote sensor alerts the processing unit when a satellite item becomes disassociated from the remote sensor beyond a predetermined period of time.

8. The alert system of claim 1, wherein each of the alert devices of the satellite items comprises a transponder.

9. The alert system of claim 8, wherein the processing unit prompts the transponder to send a signal to the remote sensor confirming a relative position of the satellite item within the alert zone.

10. The alert system of claim 1, wherein the processing unit determines the satellite distance between the remote sensor and each of the satellite items by measuring the strength of a confirmation signal from the alert device.

11. The alert system of claim 1, wherein the processing unit determines the satellite distance between the remote sensor and each of the satellite items by measuring a timing of signals received from the alert device.

12. The alert system of claim 1, wherein the alert signal comprises any one or more of: a visual signal, an audible signal, a data signal, and a video signal.

13. The alert system of claim 1, wherein one alert device is secured to one satellite item.

14. The alert system of claim 1, wherein one remote sensor is secured to one satellite item.

15. An alert system for tracking a satellite item, comprising:

a remote sensing means for defining an alert zone;

a plurality of alert means located within the alert zone and that are paired with a plurality of satellite items, for communicating with the remote sensing means to provide information about relative positions of the plurality of satellite items with respect to the alert zone and the remote sensing means; and a processing means for registering the plurality of alert means and for communicating with the remote sensing means, so that the remote sensing means alerts the processing unit when a satellite item becomes disassociated from the remote sensing means;

wherein the processing means identifies the plurality of alert means as transient items that are not limited to the alert zone, or permament items that are limited to the alert zone;

wherein the processing means calculates a satellite distance between the remote sensing means and each of the plurality of satellite items to determine the location of the plurality of satellite items relative to the remote sensing means;

wherein the processing means determines if a transient item is inappropriately located within the alert zone;

wherein the remote sensor selectively provides an alert signal if any one of the satellite items becomes disassociated from the remote sensor; and wherein the remote sensor further selectively provides the alert signal if the transient item is determined to be inappropriately located within the alert zone.

16. The alert system of claim 15, wherein the remote sensing means comprises a plurality of remote sensors that define a plurality of alert zones and that communicate with the plurality of alert devices.

17. The alert system of claim 15, wherein the remote sensing means alerts the processing means when a satellite item becomes disassociated from the remote sensing means beyond a predetermined period of time.

18. A method for tracking a satellite item, comprising:

defining an alert zone by means of a remote sensor;

locating a plurality of alert devices that are paired with a plurality of satellite items and that communicate with the remote sensor within the alert zone;

providing information about relative positions of the plurality of satellite items with respect to the alert zone and the remote sensor;

a processing unit registering the plurality of alert devices, and communicating with the remote sensor so that the remote sensor alerts the processing unit when a satellite item becomes disassociated from the remote sensor;

the processing unit identifying the plurality of alert devices as transient items that are not limited to the alert zone, or permament items that are limited to the alert zone;

the processing unit further calculating a satellite distance between the remote sensor and each of the satellite items to determine the location of the satellite items relative to the remote sensor;

the processing unit further determining if a transient item is inappropriately located within the alert zone;

the remote sensor selectively providing an alert signal if any one of the satellite items becomes disassociated from the remote sensor; and the remote sensor further selectively providing the alert signal if the transient item is determined to be inappropriately located within the alert zone.

19. The alert system of claim 18, wherein the processing unit further determines if the transient item is inappropriately located within the alert zone concurrently with a permanent item; and if the transient item is inappropriately located within the alert zone, the processing unit calculating a response time to correct an adverse situation that could arise from the transient item that is inappropriately located within the alert zone.

20. The method of claim 19, further comprising defining a plurality of alert zones by means of a plurality of remote sensors that communicate with the plurality of alert devices.

21. The method of claim 20, wherein the processing unit communicates with the plurality of the remote sensors over the Internet.

22. The alert system of claim 18, wherein each alert device periodically transmits radio-frequency signals to the remote sensor to provide the relative position information of the satellite item that is paired with each alert device.

* * * * *